US007517047B2

(12) United States Patent
Kambe

(10) Patent No.: US 7,517,047 B2
(45) Date of Patent: Apr. 14, 2009

(54) MAINTENANCE UNIT AND INK JET PRINTER

(75) Inventor: Hiroaki Kambe, Chiba (JP)

(73) Assignee: Seiko I Infotech Inc. (JP)

( * ) Notice: Subject to any disclaimer, the term of this patent is extended or adjusted under 35 U.S.C. 154(b) by 381 days.

(21) Appl. No.: 11/248,870

(22) Filed: Oct. 12, 2005

(65) Prior Publication Data

US 2006/0077223 A1 Apr. 13, 2006

(30) Foreign Application Priority Data

Dec. 21, 2004 (JP) ..... 2004-369654

(51) Int. Cl.
*B41J 2/165* (2006.01)

(52) U.S. Cl. ..... 347/29; 347/30; 347/32

(58) Field of Classification Search ..... 347/29, 347/30, 33, 32
See application file for complete search history.

(56) References Cited

U.S. PATENT DOCUMENTS 5,504,508 A 4/1996 Hashimoto ..... 347/24
5,757,395 A 5/1998 Chew et al. ..... 347/24
5,903,287 A * 5/1999 Ishikawa et al. ..... 347/24
6,081,282 A * 6/2000 Saijo ..... 347/29
6,334,663 B1 * 1/2002 Lee ..... 347/29
6,390,593 B1 * 5/2002 DeRoos et al. ..... 347/31
6,471,329 B1 * 10/2002 Maza ..... 347/29
6,709,087 B2 * 3/2004 Ansell et al. ..... 347/29
6,793,317 B2 * 9/2004 Shima ..... 347/29

FOREIGN PATENT DOCUMENTS

EP 0719645 7/1996

* cited by examiner

*Primary Examiner*—Shih-wen Hsieh
(74) *Attorney, Agent, or Firm*—Adams & Wilks

(57) ABSTRACT

For an ink jet printer, a maintenance unit having a simple mechanism that ensures a stable well-closed condition is provided. According to the present invention, rigid contact portions are provided in order to maintain a distance between an ink jet head and a cap in the perpendicular direction when the ink jet head is attached to the cap.

12 Claims, 2 Drawing Sheets

MAINTENANCE UNIT AND INK JET PRINTER

BACKGROUND OF THE INVENTION

1. Field of the Invention

The present invention relates to a maintenance unit for an ink jet head that forms images by ejecting ink, and for an ink jet printer.

2. Related Background Art

As shown in FIGS. 4 and 5, a carriage 101 that holds an ink jet head 100 is supported by a guide rail 102 along which the ink jet head 100 can be moved in the main operating direction, and along which the ink jet head 100 can be moved to a predetermined location at an appropriate acceleration and at a predetermined speed. Depending on the functions of and the specifications for an ink jet printer, a plurality of ink jet heads 100 are prepared, and the positions of the ink jet heads 100 and the distances between them are adjusted to within a predetermined range. A platen 110 is arranged, at a position facing the ink jet head 100, so that a constant distance from the ink jet head 100 is maintained, regardless of the position of the carriage 101 in the main operating direction. The platen 110 has as a function the support of an ink jet medium 130 to which suction is applied, through an infinite number of holes formed in the platen 110, to prevent the ink jet medium 130 from floating and to ensure that an appropriate distance is maintained between the ink jet head 100 and the ink jet medium 130.

Further, a capping unit 120 and a wiping unit 121 are provided at the end of the platen 110. The capping unit 120 includes a cap 122 for closing the ink jet head 100 to prevent the ink jet head 100 from drying and to suck up excess ink. As shown in FIG. 3, the capping unit 120 is held by cap springs 200, made of a flexible material, in order to obtain a contact force to be exerted between the cap 122 and the ink jet head 100, and stabilization of the contact force is aimed at by using flexible strokes of the cap springs 200. A cap holding mechanism employing the cap springs 200 is characterized in that the function can be maintained even when the distances between the cap 122 and the ink jet head 100 in the main scanning direction and in the direction perpendicular to the sub-scanning direction, and component parallelism are more or less varied. Furthermore, as another advantage, this mechanism has a simple and stable, low cost structure.

The wiping unit 121 has a wiper 123 for removing foreign substances and ink droplets attached to the ink jet head 100. When the function of the capping unit 120 and the function of the wiping unit 121 are employed together, the cleaning of the ink jet head 100 and the prevention of clogging, and stable printing are provided by a printer.

The ink jet medium 130 is sequentially conveyed across the platen 110 by the rotation of a convey roller 111 and of a nip roller 112, and is moved to an image forming location, while traveling facing the ink jet head 100. The convey roller 111 has a parameter that determines an appropriate feeding distance in accordance with the operating mode of the ink jet printer or the type of ink jet medium 130, and is rotated so as to consistently obtain an image quality. The nip roller 112 is used to press the ink jet medium 130 against the convey roller 111 with an appropriate force so that the convey roller 111 can convey the ink jet medium 130. Some ink jet printers can vary the pressing force applied in accordance with the type of ink jet medium 130. Further, a heater may be prepared for the platen 110 to accelerate the drying of ink ejected onto the ink jet medium 130.

Moreover, at present, there is an ink jet printer having a function that can vary the height of the ink jet head 100 or the carriage 101 to cope with a variety of ink jet media 130. The conventional ink jet media 130 are mainly paper, and the thicknesses range from about several tens to several hundreds of microns; however, currently, a wide range of material is being employed, such as paper, films, cloth and boards, and the thickness range for ink jet media 130 may extend to several millimeters or several of tens of millimeters. A proposal has been put forward for the production of a printer that, while taking the current situation into account, can adjust the height of a maintenance unit by employing head height information (see, for example, Japanese Patent Unexamined Publication No. 2002-361881).

Since the capping unit 120 contacts the ink jet head 100 and tightly closes the nozzle opening of the ink jet head 100 and draws in ink using suction, distances between the ink jet head 100 and the cap 122 in the direction perpendicular to the main scanning direction and in the sub-scanning direction should be appropriately maintained. Otherwise, the function of the capping unit 120 will not be maintained, and not only will the image quality be deteriorated, but also the ink jet head 100 will be damaged, and in some cases, a mechanical function fault may disable an ink jet printer. Therefore, the distance between the ink jet head 100 and the cap 122 is a very important factor in the function maintenance of an ink jet printer. Thus, conventionally, parts are specially employed to adjust the distances between the ink jet head 100 and the capping unit 120, which holds the cap 122, in the direction perpendicular to the main scanning direction and the sub-scanning direction, or the highly accurate machining of parts is employed to obtain predetermined distances between the ink jet head 100 and the capping unit 120 in the direction perpendicular to the main scanning direction and the sub-scanning direction. However, the use of special parts for the adjustment operation and the provision of very accurately machined parts contribute to increases in manufacturing costs. Further, for an ink jet printer that includes multiple ink jet heads 100, the number of sets of ink jet heads 100 and caps 122 that must be adjusted is increased, and a satisfactory contact force must be obtained for all the sets. In addition, when multiple sets of ink jet heads 100 and caps 122 are employed, the inclinations and the parallelism of the ink jet heads 100 and the caps 122 greatly affect the contact force exerted between the ink jet heads 100 and the caps 122. To resolve these problems, the use of very accurately machined parts can not be avoided. Moreover, conventionally, the thickness range of ink jet media 130 is not greatly extended, and ink jet printers are designed on the assumption that for an ink jet head 100 a constant height is adequate. However, recently, as the variety of ink jet media 130 available has increased, a new function for varying the height of an ink jet head 100 is beginning to be added to ink jet printers to permit them to cope with a variety of ink jet media 130 thicknesses. But although this function is being added, the attainment of an adequate capping unit 120 function is difficult for a conventional design based on an ink jet head 100 having a constant height. A mechanism, however, as described in Japanese Patent Unexamined Publication No. 2002-361881, has been proposed that changes the height of a capping unit or a wiping unit, and meshes with the changing of the height of an ink jet head.

SUMMARY OF THE INVENTION

One objective of the present invention is to provide a maintenance unit, for an ink jet printer that has the variable ink jet head height function described above, and an ink jet head and a capping unit, for which neither an adjustment process nor the use of highly accurate machined parts is required during assembly, that ensures a stable, well-closing condition even when there is an increased variance in the distance in the perpendicular direction.

To achieve this objective, according to the present invention, a maintenance unit for an ink jet head comprises:

an ink jet head;

a cap, for performing maintenance for the ink jet head;

a carriage, for holding the ink jet head;

a flexible member, for holding the cap; and rigid contact portions, for providing a stable distance between the ink jet head and the cap, in the perpendicular direction, when the ink jet head is closely coveted with the cap. Rigid contact portions 204 provide appropriate distances at which a cap 122 can be brought into contact with an ink jet head 100 in the direction perpendicular to the main scanning direction and in the sub-scanning direction. With this arrangement, in a non-contact state, there is a great variance in the distances between the ink jet head 100 and the cap 122 in the direction perpendicular to the main scanning direction and in the sub-scanning direction, whereas in a contact state, the sizes of the rigid contact portions 204 ensure that constant distances are maintained between the ink jet head 100 and the cap 122. Further, variances in the contact force of a flexible contact portion, that flexibly contacts the ink jet head 100 and the cap 122, can also be reduced. When multiple ink jet heads 100 and multiple caps 122 are employed, multiple rigid contact portions 204 need only be provided to obtain an accurate parallelism between the ink jet head 100 and the caps 122. In addition, since the contact force exerted between an ink jet head 100 and a cap 122 depends on the accuracy of the sizes of the rigid contact portions 204, the number of parts to be managed can be considerably reduced. A carriage 101 and a cap frame 201 are parts which make maintaining accurate distances between the respective parts, the ink jet 100 and the cap 122, comparatively easy. Therefore, the rigid contact portions 204, which in this invention are arranged between the ink jet head 100 and the cap 122, in this invention, may also be located between the carriage 101 and the capping frame 201.

When multiple ink jet heads 100 are mounted on the carriage 101 and multiple caps 122 are mounted on the capping unit 120, the size of the capping frame 201 is increased, so that adjusting the distances, relative only to the cap 122, in the direction perpendicular to the main scanning direction and in the sub-scanning direction may not be sufficient. In this case, the rigid contact portions 204 are provided for the cap frame 201, and the distances in the direction perpendicular to the main scanning direction and in the sub-scanning direction must be adjusted collectively by using the cap frame 201. As another arrangement, instead of arranging the rigid contact portions 204 in the cap 122 or the cap frame 201, the rigid contact portions 204 can be mounted in the ink jet head 100 or the carriage 101. According to this system, the same effects can also be obtained, except that the positions of the rigid contact portions 204 are different.

By providing the rigid contact portion of the invention, tight, stable closing of the ink jet headland the cap is ensured while only a simple structure is used.

DETAILED DESCRIPTION OF THE INVENTION

Figure 1:
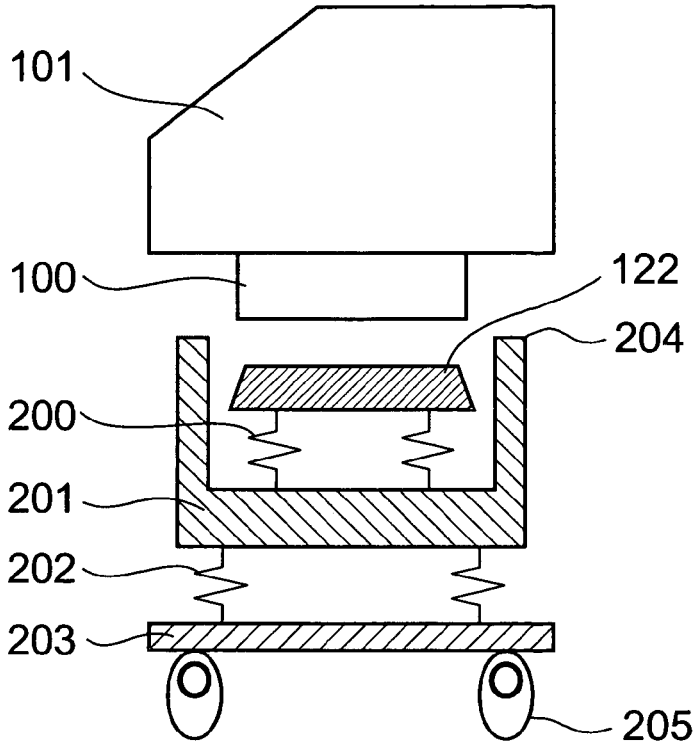
FIG. 1 is a schematic diagram showing a capping unit according to one embodiment of the present invention wherein a cap is open.
Figure 2:
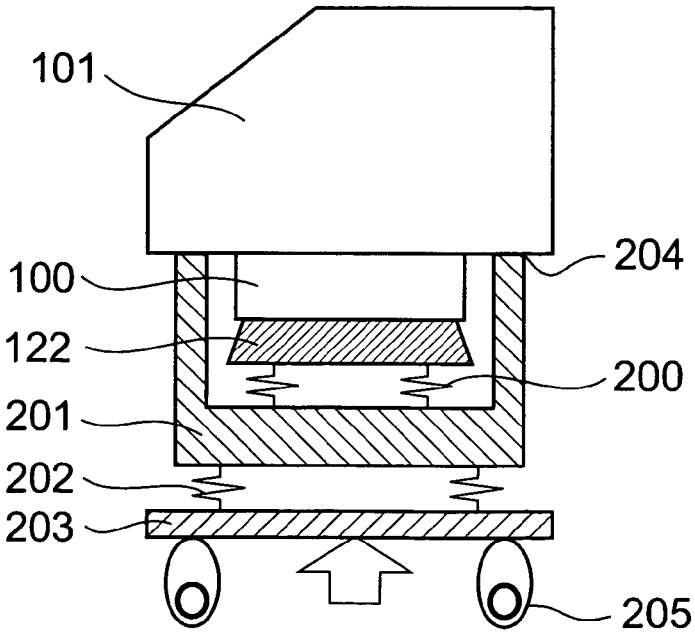
FIG. 2 is a schematic diagram showing the capping unit according to the embodiment wherein the cap is closed.
Figure 3:
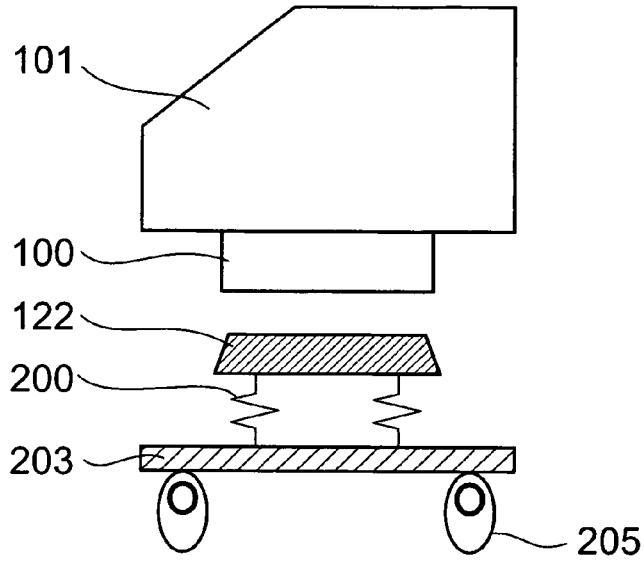
FIG. 3 PRIOR ART
FIG. 3 is a schematic diagram showing a conventional capping unit.
Figure 4:
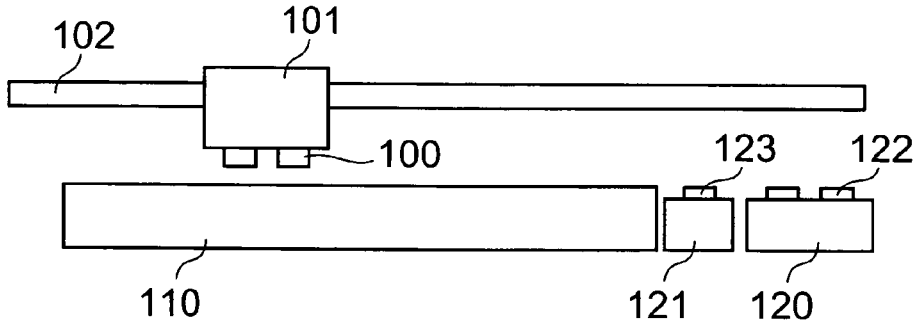
FIG. 4 is a schematic front view of an ink jet printer.
Figure 5:
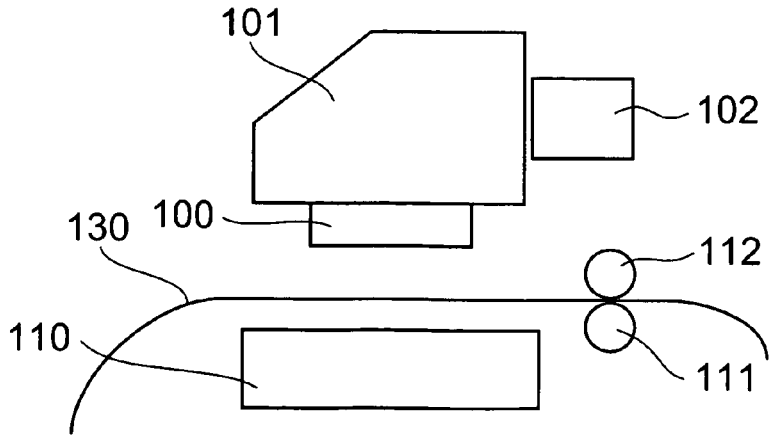
FIG. 5 is a schematic side view of the ink jet printer.

The preferred embodiment of the present invention will now be described while referring to the accompanying drawings. FIGS. 1 and 2 are diagrams showing a capping unit according to the embodiment of the present invention.

In the state shown in FIG. 1, the ink discharge opening of an ink jet head 100 has not yet been closed by a cap 122, even though it is facing the cap 122. In FIG. 1, the ink jet head 100 is supported by a carriage 101, while the cap 122 is supported by cap springs 200 in a cap frame 201, which is held, its movements limited, by frame springs 202 on a capping base or base member 203, so that it can only be moved linearly and perform a swiveling movement in direction perpendicular to the main scanning direction and the sub-scanning direction. The capping base 203 is supported by cams 205, and the positioning of the capping base 203 is determined by the operating angles of the cams 205, which can be managed by employing a motor, such as a pulse motor. Movement of the capping base 203, as well as the cap frame 201, is limited and it can not be moved relative to the main body of the ink jet printer, only in the direction perpendicular to the main scanning direction and the sub-scanning direction. Rigid contact portions 204 that contact the carriage 101 are located at the ends of the cap frame base 201, i.e., at the two places shown in FIG. 1 and at two other places perpendicular to the paper plane. Since multiple rigid contact portions 204 are thus provided, appropriate distances can be attained in the main scanning direction and in the sub-scanning direction when the ink jet head 100 is closed tightly by the cap 122. Even if a satisfactory parallelism between the ink jet head 100 and the cap 122 has not been calculated, the rigid contact portions 204 are sequentially brought into contact, and the cap frame 201 performs a swiveling movement, so that the ink jet head 100 and the cap 122 are parallel. Furthermore, when the carriage 101 is tilted, the appropriate distances between the ink jet head 100 and the cap 122 can be obtained in the close attachment state, when all the rigid contact portions 204 have been brought into contact with the carriage 101 and the cap 122 tightly closes the ink jet head opening.

In the state shown in FIG. 2, the ink jet head 100 is brought into contact with the cap 122, and the ink jet head opening is closed by cap 122. To cover the ink jet head 100 with the cap 122, first, the cams 205 are rotated to move or displace the capping base 203 toward the ink jet head 100. When the capping base 203 reaches a given position (first position), the ink jet head 100 abuts upon the cap 122; but at this position, the ink jet head 100 merely contacts the cap 122, and a satisfactory contact force has not yet been applied. Next, the capping base 203 reaches another position (second position) in which the carriage 101 and the rigid contact portions 204 on the cap frame 201 contact each other. When all the rigid contact portions 204 on the cap frame 201 have contacted the lower face of the carriage 101, the accurate distance between the cap 122 and the ink jet head 100 in the direction perpendicular to the main scanning direction and the sub-scanning direction can be obtained, and the designated contact force can be applied. Further, because of the mechanism, an accurate travel distance for the cap frame 201 is not known, and conventionally, the travel distance for the cap 122 would be managed by detecting the position of the cap 122 or by using a change in the load imposed on the drive mechanism as a consequence of the contact between the cap 122 and the ink jet head 100. However, according to the present invention, the need to detect the position of the cap 122 is eliminated, and the cams 205 can be steadily rotated to a predetermined angle to the position shown in FIG. 2. Furthermore, the extra travel distance or displacement of the capping base 203 is absorbed by contracting the frame springs 202 after the rigid contact portions 204 have been brought into contact with the carriage 101.

In this embodiment, the rigid contact portions 204 are provided on the cap frame 201. There are other two ways that the rigid contact portions 204 can be arranged, i.e., on the cap 122 and on the cap frame 201. In a case wherein a large number of caps 122 are to be employed and the size of the cap frame 201 may be increased, the rigid contact portions 204 should be arranged on the cap frame 201, so that the arrangement of the rigid contact portions 204 relative to the ink jet head 100 can be improved because the two types of springs, i.e., the cap springs 200 and the frame springs 202, can be employed. In addition, when there are multiple caps 122, the distances from the ink jet head 100 in the direction perpendicular to the main scanning direction and the sub-scanning direction differ greatly between the caps 122 at both ends, and it is difficult to adjust these distances merely by using the caps 122.

In order to obtain the above described structure, the carriage 101 and the cap frame 201 are parts for which the sizes should be managed strictly. As for the carriage 101, only the distances, between the ink jet head 100 and the lower face portions with which the rigid contact portions 204 are brought into contact with, in the direction perpendicular to the main scanning direction and the sub-scanning direction need be managed. As for the cap frame 201, only the distances, between the cap 122 attachment portions and the rigid contact portions 204, in the direction perpendicular to the main scanning direction and the sub-scanning direction need be managed.

What is claimed is:

1. A maintenance unit for an ink jet head, comprising: a carriage that carries an ink jet head; a cap configured to close an opening in the ink jet head; a cap frame that resiliently supports the cap, the cap frame having a rigid contact portion and being movable toward the ink jet head successively to a first position in which the cap closes the ink jet head opening and the rigid contact portion is spaced from and does not contact the carriage and a second position in which the cap more tightly closes the ink jet head opening and the rigid contact portion abuts the carriage; a base member that resiliently supports the cap frame; and a mechanism that displaces the base member toward the ink jet head to successively move the cap frame to its first and second positions and that continues to displace the base member toward the ink jet head after the cap frame has been moved to its second position.

2. A maintenance unit according to claim 1; wherein the cap frame has a plurality of rigid contact portions all of which abut the carriage when the cap frame is in the second position.

3. A maintenance unit according to claim 2; wherein the rigid contact portions are positioned on the cap so as to abut the carriage at positions around the ink jet head opening.

4. A maintenance unit according to claim 2; wherein the mechanism includes a cam that is rotatable through a predetermined angle and that has a cam surface in contact with the base member so that rotation of the cam through the predetermined angle effects displacement of the base member toward the ink jet head.

5. A maintenance unit according to claim 2; wherein the cap frame is resiliently supported on the base member by a frame spring.

6. A maintenance unit according to claim 5; wherein the cap is resiliently supported on the cap frame by a cap spring.

7. A maintenance unit according to claim 1; wherein the mechanism includes a cam that is rotatable through a predetermined angle and that has a cam surface in contact with the base member so that rotation of the cam through the predetermined angle effects displacement of the base member toward the ink jet head.

8. A maintenance unit according to claim 7; wherein the cap frame is resiliently supported on the base member by a frame spring.

9. A maintenance unit according to claim 8; wherein the cap is resiliently supported on the cap frame by a cap spring.

10. A maintenance unit according to claim 1; wherein the cap frame is resiliently supported on the base member by a frame spring.

11. A maintenance unit according to claim 1; wherein the cap is resiliently supported on the cap frame by a cap spring.

12. An ink jet printer having a maintenance unit according to claim 1.

* * * * *